US012599163B2

(12) United States Patent
Cagle

(10) Patent No.: US 12,599,163 B2
(45) Date of Patent: Apr. 14, 2026

(54) CANNABIS PRODUCTS AND METHODS FOR PRODUCING SAME

(71) Applicant: TAAC Naturals, LLC, Los Angeles, CA (US)

(72) Inventor: Allen Cagle, Los Angeles, CA (US)

( * ) Notice: Subject to any disclaimer, the term of this patent is extended or adjusted under 35 U.S.C. 154(b) by 0 days.

(21) Appl. No.: 17/103,241

(22) Filed: Nov. 24, 2020

(65) Prior Publication Data

US 2021/0321657 A1 Oct. 21, 2021

Related U.S. Application Data

(60) Provisional application No. 63/011,609, filed on Apr. 17, 2020.

(51) Int. Cl.

| | |
|---|---|
| ***A24B 15/30*** | (2006.01) |
| ***A24B 15/22*** | (2006.01) |
| ***A24F 40/42*** | (2020.01) |

(52) U.S. Cl.

CPC ..... *A24B 15/303* (2013.01); *A24B 15/22* (2013.01); *A24F 40/42* (2020.01)

(58) Field of Classification Search

CPC ..... A24F 40/42

See application file for complete search history.

(56) References Cited

U.S. PATENT DOCUMENTS

| | | | | |
|---|---|---|---|---|
| 7,025,992 | B2 | 4/2006 | Whittle et al. | |
| 10,717,717 | B1 | 7/2020 | Castillo | |
| 2018/0084822 | A1* | 3/2018 | Fuisz | A24B 15/24 |
| 2018/0343812 | A1* | 12/2018 | Leo | A01G 9/249 |
| 2020/0121637 | A1* | 4/2020 | Levy | A61K 31/065 |
| 2020/0289910 | A1 | 9/2020 | Dunham et al. | |
| 2021/0015786 | A1* | 1/2021 | Han | A61K 47/22 |

FOREIGN PATENT DOCUMENTS

WO WO-2020163949 A1 * 8/2020 ..... A23D 7/0053

OTHER PUBLICATIONS

"Cure Definition and Meaning." Merriam-Webster, Merriam-Webster, https://www.merriam-webster.com/dictionary/cure#h2. (Year: 2021).*

"Polyglyceryl-4 Oleate." Humblebee and Me, https://www.humblebeeandme.com/project/polyglyceryl-4-oleate/. (Year: 2021).*

* cited by examiner

*Primary Examiner* — Michael H. Wilson
*Assistant Examiner* — Stephanie Lynn Moore
(74) *Attorney, Agent, or Firm* — Aura IP Law, PC; Sheila R. Gibson

(57) ABSTRACT

The invention relates to cannabis products and methods for producing cannabis products.

19 Claims, No Drawings

CANNABIS PRODUCTS AND METHODS FOR PRODUCING SAME

CROSS REFERENCE TO RELATED APPLICATION

This application claims priority of Provisional Application No. 63/011,609, entitled "CANNABIS PRODUCTS AND METHODS FOR PRODUCING SAME," filed Apr. 17, 2020, and assigned to the assignee hereof and hereby expressly incorporated by reference herein.

BACKGROUND

The genus *Cannabis* has been in use by humans for millennia, due to the multiplicity of its benefits to humans, including the considerable value and utility of its fiber, the nutritional value of its seeds, and the medicinal value of its floral parts and products made from them. Cannabis plants include secondary metabolites called cannabinoids. Cannabinoids are hydrophobic, and can act on cannabinoid receptors in tissues and cells of the human body. Cannabidiol (CBD) is just one of at least dozens—perhaps hundreds—of cannabinoids endogenous to Cannabis. CBD extracted from Cannabis is widely used in over-the-counter medicines and topical treatments, and is also the active ingredient in the FDA-approved drug Epidiolex. The cannabinoids as a group interact with the human endocannabinoid receptors, which are distributed in the brain and throughout the body. The study of the endocannabinoid system (ECS) in humans and other mammals is an area of increasing interest and holds tremendous promise for the future of medicine. See, e.g., Russo (2019). Cannabis and Pain, *Pain Medicine,* 20(10): 1093/pm/pnz227; and Russo (2016). Clinical Endocannabinoid Deficiency Reconsidered: Current Research Supports the Theory in Migraine, Fibromyalgia, Irritable Bowel, and Other Treatment-Resistant Syndromes, *Cannabis Cannabinoid Res.* 1(1): 154-165.

SUMMARY

Some embodiments of the invention relate to a method for producing a Cannabis product. In some embodiments, the method can include the step of preparing a solution including cannabis concentrate and a distillate of at least one cannabinoid. In some embodiments, the method can further include adding a hydrophobic additive to the solution. In some embodiments, the method can include sonicating the solution to obtain a nano-emulsified solution. In some embodiments, the method can include curing the nano-emulsified solution for at least 5 hours. In some embodiments, the method can include heating the nano-emulsified solution. In some embodiments, the method can include cooling the mixture to a temperature between 100 and 140 degrees F. In some embodiments, the method can include adding at least one terpene. In some embodiments, a final product is produced, wherein the final product can be capable of consumption by vaporization and inhalation.

In some embodiments, the at least one cannabinoid can be selected from the group consisting of Δ9-tetrahydrocannabinol (Δ9-THC), Δ8-tetrahydrocannabinol (Δ8-THC), cannabichromene (CBC), caimabicyclol (CBL), cannabidiol (CBD), cannabielsoin (CBE), cannabigerol (CBG), cannabinidiol (CBND), cannabinol (CBN), cannabitriol (CB1), and their propyl homologs, including, by way of non-limiting example cannabidivarin (CBDV), Δ9-tetrahydrocannabivarin (THCV), cannabichromevarin (CBCV), cannabigerovarin (CBGV), and/or the like.

In some embodiments, the cannabinoid is THC.

In some embodiments, the hydrophobic additive is vegetable glycerin.

In some embodiments, the curing step can be performed for a period of time, for example, the period of time can be about 24 hours.

In some embodiments, the distillate can include about 80-95% THC.

In some embodiments, the temperature in the cooling step can be about 120 F.

In some embodiments, the final product can include at least 3 different cannabinoids.

In some embodiments, the final product can have increased bioavailability compared to a product produced without sonication.

Some embodiments of the invention relate to a vaporization cartridge comprising a product produced by any of the methods described herein.

DETAILED DESCRIPTION

Some embodiments of the invention relate to a method for producing a cannabis product.

The method can include preparing a solution including a cannabis concentrate and a distillate comprising a cannabinoid. The cannabis concentrate can be about 1-15% of the solution. For example, the cannabis concentrate can be about 1%, 2%, 3%, 4%, 5%, 6%, 7%, 8%, 9, 10% of the solution. In some embodiments, the cannabis concentrate can be about 4-6% of the solution.

A "cannabis concentrate" as used herein refers a post-extraction product that typically contains cannabinoids and terpenes. In many cases, a cannabis concentrate can have cannabinoids and terpenes in substantially similar relative ratios as originally found in the material from which it was extracted. The cannabis concentrate can be a cannabis extract material such as kief, dry sieve hash, dry sift, butane hash oil, shatter, budder, honeycomb, crumble, sap, RSO (Rick Simpson Oil), rosin, resin, or any other product resulting from an extraction of hydraulic press operation applied to plant, or a synthetic material that includes a cannabis derivative.

A "distillate" as used herein refers to a purified product substantially concentrated for one particular cannabinoid, and can have minor amounts of other cannabinoids present. The distillate can include 75%, 80%, 85%, 90%, 91%, 92%, 93%, 94%, 95%, or more cannabinoid. The cannabinoid can be, but is not limited to, Δ9-tetrahydrocannabinol (Δ9-THC), Δ8-tetrahydrocannabinol (Δ8-THC), cannabichromene (CBC), caimabicyclol (CBL), cannabidiol (CBD), cannabielsoin (CBE), cannabigerol (CBG), cannabinidiol (CBND), cannabinol (CBN), cannabitriol (CB1), and their propyl homologs, including, by way of non-limiting example cannabidivarin (CBDV), Δ9-tetrahydrocannabivarin (THCV), cannabichromevarin (CBCV), and cannabigerovarin (CBGV). The cannabinoid can be produced by a plant or can be a synthetic cannabinoid, and/or a cannabinoid isolated from cannabis plants.

In some embodiments, the cannabinoid is THC, derivative, or intermediate thereof. In an embodiment, THC is a plant-extract, a synthetic compound, or a semi-synthetic compound. In some embodiments, the THC, derivative, or intermediate thereof is THC.

The method can include adding a hydrophobic additive to the cannabis concentrate/cannabinoid solution. Example non-polar, hydrophobic additives can include fatty acids such as omega-3 fatty acids, eicosapentaenoic acid (EPA), docosahexaenoic acid (DHA), alpha-Linolenic acid (a-Linolenic acid; ALA), conjugated linoledc acid and oils containing fatty acids such as fish oil, algae oil, krill oil, flaxseed oil, soybean oil, and walnut oil. Example additives to the solution include compounds containing and contained in fatty acids such for example, triglycerides, including, polar lipids, for example, phosphoric acid, choline, fatty acid chains, glycerol, vegetable glycerin, glycolipids, triglycerides, fatty acid esters, and phospholipids (e.g., phosphatidylcholine, phosphatidylethanolarnine, and phosphatidylinositol). Alternatively or in addition, example additives to the solution are compounds containing fat-soluble vitamins, for example, Vitamins D, E, K, and A, corresponding provitamins and vitamin derivatives such as esters. Additionally, water-soluble vitamins, made lipid soluble can also be included. For example, ascorbyl palmitate, a fat-soluble version of vitamin C. Example non-polar additives to the oil/wax include compounds containing carotenoids such as beta carotene, mixed carotenoids (mixtures of alpha and beta), zeaxanthin, capsanthin, cantfaaxanthin, bixin lycopene, violerythrin, gamma carotene, astaxanthin, and lutein. In some embodiments, the additive is a lipid derived from or found in a cannabis plant.

In some embodiments, the additive is added to the solution in an amount of from about 1% to about 99%, by weight of the solution. In some embodiments, the additive is present in a composition in an amount of about 1%, about 5%, about 10%, about 15%, about 20%, about 25%, about 30%, about 35%, about 40%, about 45%, about 50%, about 55%, about 60%, about 65%, about 70%, about 75%, about 80%, about 85%, about 90%, about 95%, or about 99%. In some embodiments, the additive is added in an amount of about 1% to about 99%, from about 1% to about 90%, from about 1% to about 80%, from about 1% to about 70%, from about 1% to about 60%, from about 1% to about 50%, from about 1% to about 40%, from about 1% to about 30%, from about 1% to about 20%, or from about 1% to about 10%. In some embodiments, the additive is 1-5% vegetable glycerin. In some embodiments, the additive is 1-10% lipid.

In some embodiments, the method does not include adding an additional solvent as in traditional methods.

In some embodiments, the method includes sonicating the cannabis concentrate/cannabinoid/additive solution to obtain a nano-emulsified solution. The sonicating step can include adding the distillate, concentrate and additive to a container; heating the mixture to 150 F; homogenizing the heated product (e.g., 15,000 rpm-32,000 rpm using a sonicator). In some embodiments, the heated product is homogenized 1-1000 g at a time.

In some embodiments, the method includes curing the nano-emulsified solution for an amount of time. The amount of time can be about at least 5, 6, 7, 8, 9, 10, 11, 12, 13, 14, 15, 16, 17, 18, 19, 20, 21, 22, 23, 24, or more hours. In some embodiments, the solution is cured in a cool dry environment for 12-24 hours.

In some embodiments, the method includes heating the cured nano-emulsified solution.

In some embodiments, the method includes cooling the heated cured nano-emulsified solution to a temperature. The temperature can be between about 80 and 160 degrees F. or 100 and 140 degrees F.

In some embodiments, the method includes adding at least one terpene and/or terpenoid to the cooled solution to produce a final cannabis product. Terpenes and terpenoids are the primary constituents of the essential oils or many types of plants and flowers. Terpenes can be converted to or replaced by a terpenoid, synthetic terpenoid or semisynthetic terpenoid by any known chemical reactions. The terpene can be, but is not limited to, alpha-pinene, beta-pinene, beta-myrcene, alpha-terpinene, limonene, beta-ocimene, terpinolene, linalool, fenchyl alcohol, borneol isomers, alpha-terpineol, trans-caryophyllene, alpha-humulene, trans-nerolidol, guaiol, alpha-bisabolol, and combinations thereof. Suitable terpenoids (and substances that include combinations of terpenes and terpenoids) can include, but is not limited to, a-pinene, β-pinene, pine, linalool, lavender, black pepper, myrcene, musk, limonene, citrus, terpineol, lilac, nerolidol, wood bark, eucalyptol, mint, borneol, camphor; a-bisabolol, floral; D-3 Carene, pine, camphene, herbal, β-caryophyllene, Borneol, 1,8-cineole, camphene, humulene, limonene, linalool, nerolidol, pulegone, terpinolene, a-phellandrene, A3-carene, a-terpinene, β-phellandrene, cis-ocimene, terpinolene, β-caryophyllene, a-guaiene, humulene, δ-guaiene, elemene, guaiol, γ-eudesmol, β-eudesmol, agarospirol, bulnesol, and a-bisabolol.

In some embodiments, the solution remains nano-emulsified throughout the method after the sonication step.

The cannabis product can include at least one terpene in an amount from about 0.001 mg/mL to about 1 mg/mL. In some embodiments, the composition can include at least one terpene in an amount of about 0.001 mg/mL to about 0.95 mg/mL, or about 0.003 mg/mL to about 0.9 mg/mL, or about 0.005 mg/mL to about 0.8 mg/mL. In some embodiments, the composition can include at least one terpene in an amount of about 0.01 mg/mL, about 0.15 mg/mL, about 0.02 mg/mL, about 0.25 mg/mL, about 0.03 mg/mL, about 0.35 mg/mL, about 0.04 mg/mL, about 0.45 mg/mL, about 0.05 mg/mL, about 0.55 mg/mL, about 0.06 mg/mL, about 0.65 mg/mL, about 0.07 mg/mL, about 0.75 mg/mL, about 0.08 mg/mL, about 0.085 mg/mL, about 0.09 mg/mL, about 0.95 mg/mL, or about 1 mg/mL. The concentrations listed is the total concentration of all the terpenes in the composition.

In some embodiments, the cannabis product includes a cannabinoid, such as THC, in an amount of from about 0.5 mg/mL to about 30 mg/mL. In some embodiments, the composition includes the THC, derivative, or intermediate thereof, and combinations thereof in an amount of from about 1 mg/mL to about 30 mg/mL, from about 2 mg/mL to about 28 mg/mL, from about 5 mg/mL to about 27 mg/mL, from about 5 mg/mL to about 25 mg/mL, from about 5 mg/mL to about 20 mg/mL, from about 5 mg/mL to about 15 mg/mL, or about 5 mg/mL to about 10 mg/mL. In some embodiments, the composition includes the THC, derivative, or intermediate thereof, and combinations thereof in an amount of about 0.5 mg/mL, about 0.75 mg/mL, about 1 mg/mL, about 5 mg/mL, about 10 mg/mL, about 15 mL, about 20 mg/mL, about 25 mg/mL, or about 30 mg/mL.

In some embodiments, the cannabis product has a golden-brown appearance.

In some embodiments, the cannabis product has at least 3 cannabinoids. In some embodiments, the cannabis product has at least 4, 5, 6, 7, 8, 9, or more cannabinoids.

In some embodiments, the cannabis product prepared by means of the invention has improved characteristics compared to a cannabis product prepared without the sonication/emulsion step. Improved characteristics include increased bio availability, improved odor, etc.

In some embodiments, the cannabis product has a more pleasant odor compared to a cannabis product prepared without the curing step.

In some embodiments, the cannabis product is capable of consumption by vaporization and inhalation. The final product is capable of being placed in an inhaler, vaporizer, vape pen, or the like.

Some embodiments of the invention relate to the production of a cartridge suitable for use in a vaporizer, vape pen, or the like, comprising adding the cannabis product produced by the methods disclosed herein to a cartridge.

Some embodiments of the invention relate to a cannabis product produced by the methods disclosed herein. The cannabis product can include a cannabis concentrate, a cannabinoid and at least one terpene.

Some embodiments of the invention relate to a cartridge including the cannabis product disclosed herein.

The invention provides embodiments that include numerous possible formulations having different effects and flavor profiles. The following tables includes non-limiting examples of these possible formulations. Other formulations can be made based upon the principles and guidance provided herein.

EXAMPLES

The present invention will be more specifically described by means of the following Examples which, however, are not intended to limit the scope of the present invention.

Example 1

Concentrate Cut

| | |
|---|---|
| Lipids | 12% (3% total volume) |
| Concentrate | 40% (10% total volume) |
| Distillate | 48% |

Heat up to 60 degrees celsius and emulsify mixture together. This product is called 'concentrate cut'

Final Solution

| | |
|---|---|
| Distillate | 60% (this is an addition to the distillate in the concentrate cut) |
| Concentrate Cut (above formula) | 25% |
| Terpenes | 15% |

Mix distillate and concentrate cut together at 60 degrees celsius. Remove from heat and let the product cool to 49 degrees celsius before adding terpenes.

Example 2

Concentrate Cut

| | |
|---|---|
| Vegetable Glycerin | 20% (5% total volume) |
| Concentrate | 32% (8% total volume) |
| Distillate | 48% |

Final Solution

| | |
|---|---|
| Distillate | 60% (this is an addition to the distillate in the concentrate cut) |
| Concentrate Cut (above formula) | 25% |
| Terpenes | 15% |

Example 3

Concentrate Cut

| | |
|---|---|
| Lipids | 4% (1% total volume) |
| Concentrate | 48% (12% total volume) |
| Distillate | 48% |

Final Solution

| | |
|---|---|
| Distillate | 60% (this is an addition to the distillate in the concentrate cut) |
| Concentrate Cut (above formula) | 25% |
| Terpenes | 15% |

Example 4

The following is an analysis of an embodiment of the invention wherein the composition includes a lipid derived from a Cannabis plant.

Sample ID: 2008CSALA0220.1293
Matrix: Concentrates & Extracts
Sample Size: 1 unit
Collected: Aug. 24, 2020
Received: Aug. 24, 2020
Completed: Sep. 8, 2020
Total THC: 68.10%
Total CBD: 0.23%
Total Cannabinoids: 72.35%
Cannabinoids Pass
Testing method: HPLC-SOP 101

| Analyte | LOD (mg/g) | LOQ (mg/g) | Results (%) | Results (mg/g) |
|---|---|---|---|---|
| Δ9-THC | 0.0038 | 0.0115 | 61.86 | 618.62 |
| THCa | 0.002 | 0.006 | 7.11 | 71.08 |
| CBG | 0.0047 | 0.0143 | 1.44 | 14.35 |
| CBC | 0.0009 | 0.0027 | 0.58 | 5.77 |
| THCV | 0.0036 | 0.0111 | 0.53 | 5.35 |
| CBN | 0.0014 | 0.0041 | 0.43 | 4.33 |
| CBD | 0.0059 | 0.018 | 0.23 | 2.27 |
| CBGa | 0.0016 | 0.005 | 0.17 | 1.75 |
| CBDa | 0.0012 | 0.0037 | ND | ND |
| CBDV | 0.0042 | 0.0126 | ND | ND |
| Δ8-THC | 0.0038 | 0.0115 | ND | ND |
| Total | | | 72.35 | 723.51 |

Date Tested: Aug. 26, 2020
Total THC = (THCa * 0.877) + Δ9-THC;
Total CBD = (CBDa * 0.877) + CBC
LOQ = Limit of Quantitation; The reported result is based on a sample weight with the applicable moisture content for that sample.

Example 5

The following is an analysis of an embodiment of the invention wherein the composition includes vegetable glycerin.

Sample ID: 2003PHS0256.0707
Matrix: Concentrates & Extracts
Sample Size: 27 units; Batch: 1,000 units
Produced: Mar. 3, 2020
Received: Mar. 10, 2020
Completed: Mar. 16, 2020

Summary

| Test | Date Tested | Result |
|---|---|---|
| Cannabinoids | Mar. 10, 2020 | Complete |
| Residual Solvents | Mar. 12, 2020 | Pass |
| Microbials | Mar. 10, 2020 | Pass |
| Mycotoxins | Mar. 12, 2020 | Pass |
| Pesticides | Mar. 12, 2020 | Pass |
| Heavy Metals | Mar. 13, 2020 | Pass |
| Foreign Matter | Mar. 10, 2020 | Pass |

Cannabinoids

Total THC: 75.05%

Total CBD: 0.211%

| Analyte | LOD (mg/g) | LOQ (mg/g) | Results (%) | Results (mg/g) |
|---|---|---|---|---|
| THCa | 0.01 | 0.01 | 3.001 | 30.1 |
| Δ9-THC | 0.05 | 0.17 | 742.421 | 742.21 |
| Δ8-THC | 0.08 | 0.27 | ND | ND |
| CBDa | 0.06 | 0.20 | ND | ND |
| CBD | 0.07 | 0.25 | 0.211 | 2.11 |
| CBN | 0.10 | 0.60 | 1.117 | 11.17 |
| CBGa | 0.07 | 0.26 | ND | ND |
| CBG | 0.04 | 0.15 | 2.832 | 28.32 |
| CBC | 0.15 | 0.50 | 0.861 | 8.61 |
| Total THC | | | 75.053 | 750.53 |
| Total CBD | | | 0.211 | 2.11 |

Total THC = (THCa * 0.877) + Δ9-THC;
Total CBD = (CBDa * 0.877) + CBC
LOQ = Limit of Quantitation;
LOD = Limit of Detection;
NT = Not Tested;
ND = Not Detected.

Example 6

The following is an analysis of an embodiment of the invention wherein the composition includes vegetable glycerin.

Sample 1A4060300008D1D000006062

Matrix: Concentrates & Extracts

Sample Size: 27 units; Batch: 1,000 units

Produced: Mar. 3, 2020

Collected: Mar. 10, 2020

Received: Mar. 10, 2020

Completed: Mar. 16, 2020

Batch #: PHD-MW001

Summary

| Test | Date Tested | Result |
|---|---|---|
| Cannabinoids | Mar. 10, 2020 | Complete |
| Residual Solvents | Mar. 12, 2020 | Pass |
| Microbials | Mar. 10, 2020 | Pass |
| Mycotoxins | Mar. 12, 2020 | Pass |
| Pesticides | Mar. 12, 2020 | Pass |
| Heavy Metals | Mar. 13, 2020 | Pass |
| Foreign Matter | Mar. 10, 2020 | Pass |

Cannabinoids

Total THC: 75.063%

Total CBD: 0.217%

| Analyte | LOD (mg/g) | LOQ (mg/g) | Results (%) | Results (mg/g) |
|---|---|---|---|---|
| THCa | 0.01 | 0.01 | 3.233 | 32.33 |
| Δ9-THC | 0.05 | 0.17 | 72.228 | 722.28 |
| Δ8-THC | 0.08 | 0.27 | ND | ND |
| CBDa | 0.06 | 0.20 | ND | ND |
| CBD | 0.07 | 0.25 | 0.217 | 2.17 |
| CBN | 0.10 | 0.60 | 1.188 | 11.88 |
| CBGa | 0.07 | 0.26 | ND | ND |
| CBG | 0.04 | 0.15 | 2.911 | 29.11 |
| CBC | 0.15 | 0.50 | 0.879 | 8.79 |
| Total THC | | | 75.063 | 750.63 |
| Total CBD | | | 0.217 | 2.17 |

Total THC = (THCa * 0.877) + Δ9-THC;
Total CBD = (CBDa * 0.877) + CBC
LOQ = Limit of Quantitation; The reported result is based on a sample weight with the applicable moisture content for that sample.

Example 7

The following is an analysis of an embodiment of the invention wherein the composition includes vegetable glycerin.

Sample: 1A4060300008D1D000006064

Matrix: Concentrates & Extracts

Sample Size: 27 units; Batch: 1,000 units

Produced: Mar. 3, 2020

Collected: Mar. 10, 2020

Received: Mar. 10, 2020

Completed: Mar. 16, 2020

Batch #: PHD-FF001

Summary

| Test | Date Tested | Result |
|---|---|---|
| Cannabinoids | Mar. 10, 2020 | Complete |
| Residual Solvents | Mar. 12, 2020 | Pass |
| Microbials | Mar. 10, 2020 | Pass |
| Mycotoxins | Mar. 12, 2020 | Pass |
| Pesticides | Mar. 12, 2020 | Pass |
| Heavy Metals | Mar. 13, 2020 | Pass |
| Foreign Matter | Mar. 10, 2020 | Pass |

Cannabinoids

Total THC: 76.494%

Total CBD: 0.254%

| Analyte | LOD (mg/g) | LOQ (mg/g) | Results (%) | Results (mg/g) |
|---|---|---|---|---|
| THCa | 0.01 | 0.01 | 3.869 | 38.69 |
| Δ9-THC | 0.05 | 0.17 | 73.1 | 731.00 |
| Δ8-THC | 0.08 | 0.27 | ND | ND |
| CBDa | 0.06 | 0.20 | ND | ND |
| CBD | 0.07 | 0.25 | 0.254 | 2.54 |
| CBN | 0.10 | 0.60 | 1.145 | 11.54 |
| CBGa | 0.07 | 0.26 | ND | ND |
| CBG | 0.04 | 0.15 | 2.44 | 24.42 |
| CBC | 0.15 | 0.50 | 0.879 | 8.79 |
| Total THC | | | 76.494 | 764.94 |
| Total CBD | | | 0.254 | 2.54 |

Total THC = (THCa * 0.877) + Δ9-THC;
Total CBD = (CBDa * 0.877) + CBC
LOQ = Limit of Quantitation; The reported result is based on a sample weight with the applicable moisture content for that sample.

The various methods and techniques described above provide a number of ways to carry out the application. Of course, it is to be understood that not necessarily all objectives or advantages described are achieved in accordance with any particular embodiment described herein. Thus, for example, those skilled in the art will recognize that the methods can be performed in a manner that achieves or optimizes one advantage or group of advantages as taught herein without necessarily achieving other objectives or advantages as taught or suggested herein. A variety of alternatives are mentioned herein. It is to be understood that some embodiments specifically include one, another, or several features, while others specifically exclude one, another, or several features, while still others mitigate a particular feature by including one, another, or several other features.

Furthermore, the skilled artisan will recognize the applicability of various features from different embodiments. Similarly, the various elements, features and steps discussed above, as well as other known equivalents for each such element, feature or step, can be employed in various combinations by one of ordinary skill in this art to perform methods in accordance with the principles described herein. Among the various elements, features, and steps some will be specifically included and others specifically excluded in diverse embodiments.

Although the application has been disclosed in the context of certain embodiments and examples, it will be understood by those skilled in the art that the embodiments of the application extend beyond the specifically disclosed embodiments to other alternative embodiments and/or uses and modifications and equivalents thereof.

In some embodiments, any numbers expressing quantities of ingredients, properties such as molecular weight, reaction conditions, and so forth, used to describe and claim certain embodiments of the disclosure are to be understood as being modified in some instances by the term "about." When "about" is used in the specification or in a claim, it refers to a number range, varying from the recited number in an amount that, taking into account the number itself and the quality of the characteristic to which the number refers, accounts for variability in measurement or performance that does not change the quality of the numerically-expressed characteristic. In the absence of information to the contrary, "about" can refer to the number plus or minus 0.1%, 0.5%, 1% or 5% of the number itself, as would be appreciated by a person of ordinary skill in the art in reference to the characteristic to which the number refers and the normal quantitative variability around that number that would be understood to not materially change that characteristic. Accordingly, in some embodiments, the numerical parameters set forth in the written description and any included claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the application are approximations, the numerical values set forth in the specific examples are usually reported as precisely as practicable.

In some embodiments, the terms "a" and "an" and "the" and similar references used in the context of describing a particular embodiment of the application (especially in the context of certain claims) are construed to cover both the singular and the plural. The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (for example, "such as") provided with respect to certain embodiments herein is intended merely to better illuminate the application and does not pose a limitation on the scope of the application otherwise claimed. No language in the specification should be construed as indicating any non-claimed element essential to the practice of the application.

Variations on preferred embodiments will become apparent to those of ordinary skill in the art upon reading the foregoing description. It is contemplated that skilled artisans can employ such variations as appropriate, and the application can be practiced otherwise than specifically described herein. Accordingly, many embodiments of this application include all modifications and equivalents of the subject matter recited in the claims appended hereto as permitted by applicable law. Moreover, any combination of the above-described elements in all possible variations thereof is encompassed by the application unless otherwise indicated herein or otherwise clearly contradicted by context.

All patents, patent applications, publications of patent applications, and other material, such as articles, books, specifications, publications, documents, things, and/or the like, referenced herein are hereby incorporated herein by this reference in their entirety for all purposes, excepting any prosecution file history associated with same, any of same that is inconsistent with or in conflict with the present document, or any of same that may have a limiting effect as to the broadest scope of the claims now or later associated with the present document. By way of example, should there be any inconsistency or conflict between the description, definition, and/or the use of a term associated with any of the incorporated material and that associated with the present document, the description, definition, and/or the use of the term in the present document shall prevail.

In closing, it is to be understood that the embodiments of the application disclosed herein are illustrative of the principles of the embodiments of the application. Other modifications that can be employed can be within the scope of the application. Thus, by way of example, but not of limitation, alternative configurations of the embodiments of the application can be utilized in accordance with the teachings herein. Accordingly, embodiments of the present application are not limited to that precisely as shown and described.

The invention claimed is:

1. A method for producing a Cannabis product comprising the steps of:

i. preparing a first mixture comprising a cannabis concentrate, a hydrophobic additive and a first amount of a distillate of at least one cannabinoid, wherein preparing the first mixture does not comprise adding water;

ii. sonicating the first mixture to obtain a nano-emulsified concentrate cut;

iii. curing the nano-emulsified concentrate cut for at least 5 hours;

iv. heating the nano-emulsified concentrate cut and a second amount of a distillate of at least one cannabinoid and forming a second mixture;

v. cooling the second mixture to a temperature between 100 and 140 degrees F.; and vi. adding at least one terpene to the second mixture and forming a final product;

wherein the final product is capable of consumption by vaporization and inhalation.

2. The method of claim 1, wherein the at least one cannabinoid is selected from the group consisting of 119-tetrahydrocannabinol (119-THC), 118-tetrahydrocannabinol (118-THC), cannabichromene (CBC), caimabicyclol (CBL), cannabidiol (CBD), cannabielsoin (CBE), cannabigerol (CBG), cannabinidiol (CBND), cannabinol (CBN), cannabitriol (CB 1), and their propyl homologs, including, by way of non-limiting example cannabidivarin (CBDV), 119-tetrahydrocannabivarin (THCV), cannabichromevarin (CBCV), and cannabigerovarin (CBGV).

3. The method of claim 2, wherein the cannabinoid is THC.

4. The method of claim 1, wherein the curing step is performed for a period of time, wherein the period of time is about 24 hours.

5. The method of claim 1, wherein the distillate comprises about 80-95% THC.

6. The method of claim 1, wherein the temperature is about 120 F.

7. The method of claim 1, wherein the final product comprises at least 3 different cannabinoids.

8. The method of claim 1, wherein the final product has increased bioavailability compared to a product produced without sonication.

9. A vaporization cartridge comprising a product produced by the method of claim 1.

10. The method of claim 1, wherein the method does not include adding a solvent to the first mixture.

11. The method of claim 1, wherein the hydrophobic additive is a polar lipid.

12. The method of claim 1, wherein the hydrophobic additive is a lipid derived from or found in a cannabis plant.

13. The method of claim 12, wherein the hydrophobic additive is a lipid derived from a cannabis plant.

14. The method of claim 12, wherein the hydrophobic additive is a vegetable glycerin.

15. The method of claim 1, wherein the hydrophobic additive is present in the final product in an amount of about 1-10% of total volume.

16. The method of claim 1, wherein the hydrophobic additive is present in the final product in an amount of about 1-5% of total volume.

17. The method of claim 1, wherein the curing step is performed in a cool dry environment for 12 to 24 hours.

18. The method of claim 1, wherein the curing step is performed for about 8 hours.

19. The method of claim 1, wherein the curing step is performed for about 10 hours.

* * * * *